United States Patent [19]

Mele

[11] 4,182,304

[45] Jan. 8, 1980

[54] DOWNDRAFT FURNACE

[76] Inventor: Peter Mele, Dover Rd., Barneveld, N.Y. 13304

[21] Appl. No.: 837,859

[22] Filed: Sep. 29, 1977

[51] Int. Cl.[2] ..... F24B 5/04

[52] U.S. Cl. ..... 126/76; 126/77; 110/315

[58] Field of Search ..... 126/77, 112, 76, 103; 110/302, 315; 98/40 N

[56] References Cited

U.S. PATENT DOCUMENTS

| | | | |
|---|---|---|---|
| 596,028 | 12/1897 | Girtanner et al. | 126/76 X |
| 1,254,777 | 11/1918 | Colegrove | 126/112 |
| 1,341,580 | 5/1920 | Pelton | 126/77 |
| 2,433,036 | 12/1947 | Fellows | 110/315 X |
| 2,469,639 | 5/1949 | Franklin | 126/76 X |
| 2,607,335 | 8/1952 | Harding | 126/77 X |
| 2,807,992 | 10/1957 | Ehman | 98/40 N |

FOREIGN PATENT DOCUMENTS

| | | | |
|---|---|---|---|
| 958259 | 2/1957 | Fed. Rep. of Germany | 98/40 N |

*Primary Examiner*—William F. O'Dea
*Assistant Examiner*—William E. Tapolcai, Jr.
*Attorney, Agent, or Firm*—Kane, Dalsimer, Kane, Sullivan and Kurucz

[57] ABSTRACT

The disclosure is of a downdraft furnace fired by solid, carbonaceous fuels such as wood logs, coal and the like. The furnace is adapted for burning the fuel in three stages, to obtain complete combustion. The advantage of the furnace of the invention resides in its heating efficiency with few pollutants released into the atmosphere.

13 Claims, 12 Drawing Figures

FIG.8
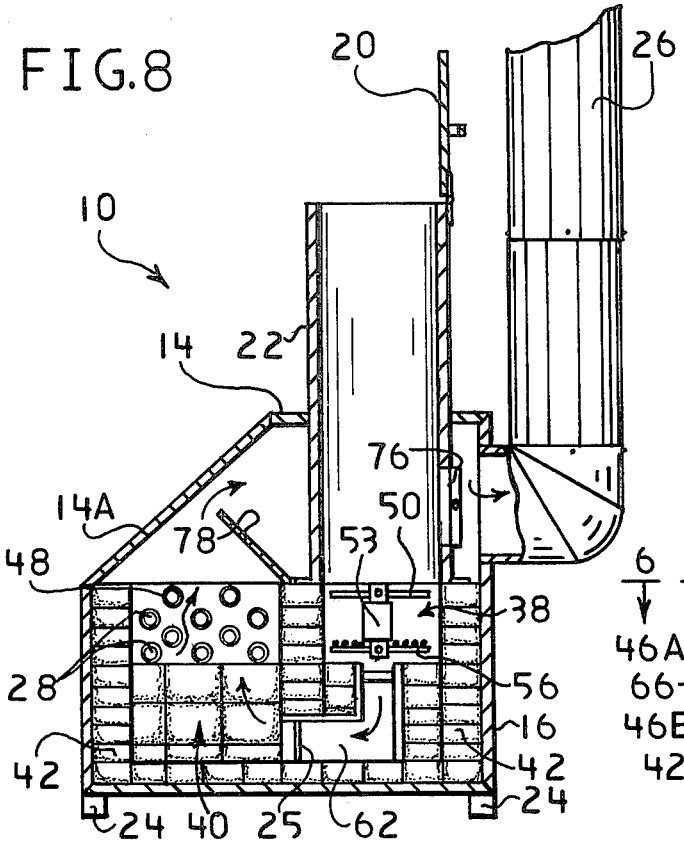
FIG.5
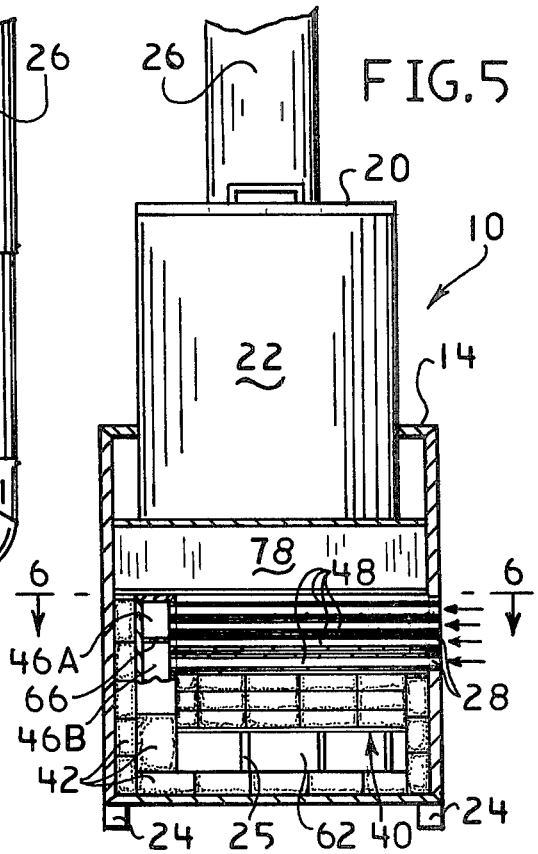
FIG.6
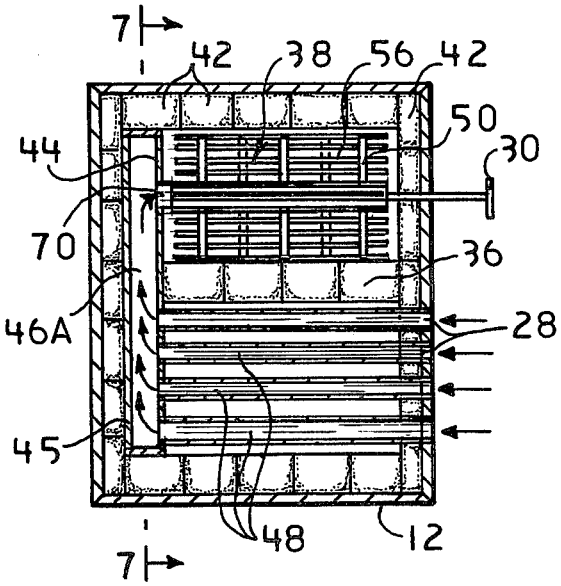
FIG.7
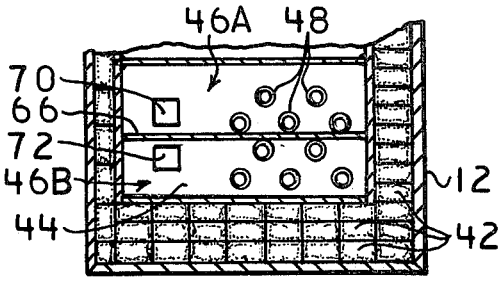
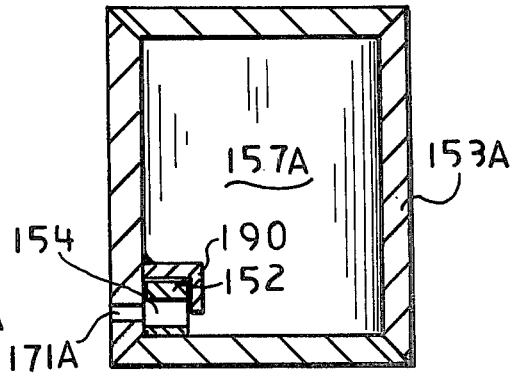
FIG.10A

DOWNDRAFT FURNACE

BACKGROUND OF THE INVENTION

1. Field of the Invention

The invention relates to stoves and furnaces for space and water heating and more particularly relates to furnaces fired by the combustion of solid, carbonaceous fuels such as wood logs.

2. Brief Description of the Prior Art

The literature is replete with descriptions of space and water heating furnaces (stoves) fired by solid carbonaceous fuels such as wood logs, coal and the like. Lately there has been a renewed interest in such furnaces as a means of heating homes, business establishments, etc. Naturally there is also a renewed interest in increasing the efficiency of such furnaces and reducing their potential for air pollution. The low efficiency (30–50% efficient) and polluting aspects of the heretofore available furnaces is generally related to incomplete combustion and poor heat transfer of fuels. Other furnaces of the prior art are known which exhibit relatively complete combustion, but due to structure, utilize the heat poorly.

Combustion is a chemical reaction releasing heat. The element oxygen is the sole supporter of combustion and therefore combustion may be defined as the combining of a substance with oxygen with consequent release of heat. Perfect combustion is theoretically possible but rare in practice. It comprises bringing each unit of combustible, heated to its ignition temperature, together with the precise quantity of oxygen required for combustion. Three factors are involved in perfect combustion; (1) The precise proportion of oxygen required to combust the fuel (combustible), (2) Thorough and complete admixture of combustible and oxygen and (3) A teperature sufficiently high to promote rapid combination of the oxygen with the combustible fuel.

In practice, the second factor, thorough and complete mixture of proper proportions of oxygen and combustible has been the most difficult to achieve in the heretofore available stoves or furnaces. The principal source of oxygen is air or the atmosphere. In air, there is about 23.15 parts oxygen and 76.85 parts by weight of nitrogen (ignoring minor proportions of other gases). In order to acquire the 1 lb. of oxygen for combustion one must provide at the point of ignition, it is necessary to present at that point 4.32 lbs. of air, including 3.32 lbs. of nitrogen which serves no purpose in combination and in a way is deterimental to desired admixture of the oxygen and combustible. This is because is absorbs heat and reduces the temperature of the products of combustion. The latter is of course detrimental to the third factor described above as an element of perfect combustion. Atmospheric nitrogen is the chief source of heat loss in combustion. It is therefore highly advantageous to provide air to the site of combustion, without an excess beyond that which is required to have the exact amount of oxygen present for complete combustion of the combustible. Excess oxygen, i.e.; that in excess of the proportion which will unite with the combustible, is also undesired because the excess also results in heat loss, absorbed by the excess gas. Further, excess oxygen is accompanied by additional nitrogen which accentuates the heat loss from the combustion. The loss equals the amount of heat units required to heat the excess air to the temperaure of the flue gas and more. Since the specific heat of air is generally higher than the specific heat of the furnace radiators (iron) the excess air absorbs a percentage of heat which otherwise would have been absorbed by the radiators. Excess air will also reduce the percentage of carbon dioxide in the flue gases. With perfect combustion, 12 parts by weight of carbon from the combustible will unit with 32 parts by weight of oxygen. The temperature of this reaction is 4980° F. and the quantity of heat generated is 14,450 B.t.u. per lb. of carbon. The theoretical content of the flue gas is 21 percent by weight carbon dioxide, but this will be reduced in proportion to excess air provided at the combustion site. The percentage of carbon dioxide in the stack gas is an indication of combustion efficiency and a measure of excess air provided at the combustion site. On the other hand, if the oxygen supplied to the site of combustion is inadequate to sustain complete combustion, fuel value is lost due to incomplete heat release. If less oxygen is supplied than is required by the carbon presense, the gases of combustion will pass from the furnace as carbon monoxide (this reaction occurs at 2700° F. and only generates 4350 B.t.u. per lb. of carbon) or as carbon itself in the form of smoke. This is a serious waste of potential fuel.

The furnace of my invention is adapted to permit control of and delivery of preheated air, in advantageous and metered proportions at the combustion site. This is accomplished by delivery of oxygen bearing air in two stages, for intimate admixture during three stages of combustion. The advantage of the furnace of the invention resides in its ability to satisfy the three factors for perfect combustion to a high degree. The result is near perfect combustion with consequent heating efficiency and absence of significant pollutant release to the atmosphere.

For a review of prior art furnaces see Hand, Popular Science, October 1976, page 104 and U.S. Pat. Nos. 420,503; 498,826; 585,027; 661,257; 739,726; 152,566; 1,360,934; and 2,789,554.

SUMMARY OF THE INVENTION

The invention comprises a solid carbonaceous fuel furnace, which comprises;

A heat-resistant enclosure defining an interior chamber;

a heat-resistant partition dividing the chamber into a first zone and a second zone;

a passageway through said partition with an inlet in the first zone and an outlet in the second;

a thermally conductive, closed pipe traversing the second zone, havng an inlet opening outside of the enclosure and an outlet opening into the chamber;

a grate mounted in the first zone, dividing the first zone into a fuel ignition zone and an ash receiving zone;

means for access to the grate for loading solid, carbonaceous fuels therein;

a manifold mounted on an outlet of said pipe and traversing the first zone, said manifold adapted to exhaust a gas substantially evenly along its length, at a point adjacent the upper surface of the grate and at a point adjacent to said passageway inlet.

The term "heat-resistant" as used herein means the material is substantially undestructed upon firing of the furnace of the invention.

The term "downdraft furnace" as used throughout the specification and claims means a furnace of the type wherein the primary air for combustion, i.e.; the air provided for combustion of the starting fuel material, is forced through the hot coals of the burned fuel. The primary air generally enters above or before the fire and in this draft pattern generally flows through the bed of glowing coals pulling volatiles within the air. This is distinctly different from the conventional furnace where the draft pattern is generally characterized by passage of the primary air upwardly from the base of the fire, and away from burning coals. The term is not necessarily restricted to a vertically "downward" flow of draft.

BRIEF DESCRIPTION OF THE DRAWINGS

FIG. 5 is a cross-sectional front elevation of he furnace of FIG. 1.

FIG. 6 is a view along lines 6—6 of FIG. 5.

FIG. 7 is a view along lines 7—7 of FIG. 6.

FIG. 8 is a cross-sectional elevation of the furnace of FIG. 2.

FIG. 10A is an enlarged cross-sectional side elevation of the primary air distribution components shown in FIG. 10.

DETAILED DESCRIPTION OF THE PREFERRED EMBODIMENTS OF THE INVENTION

Figure 1:
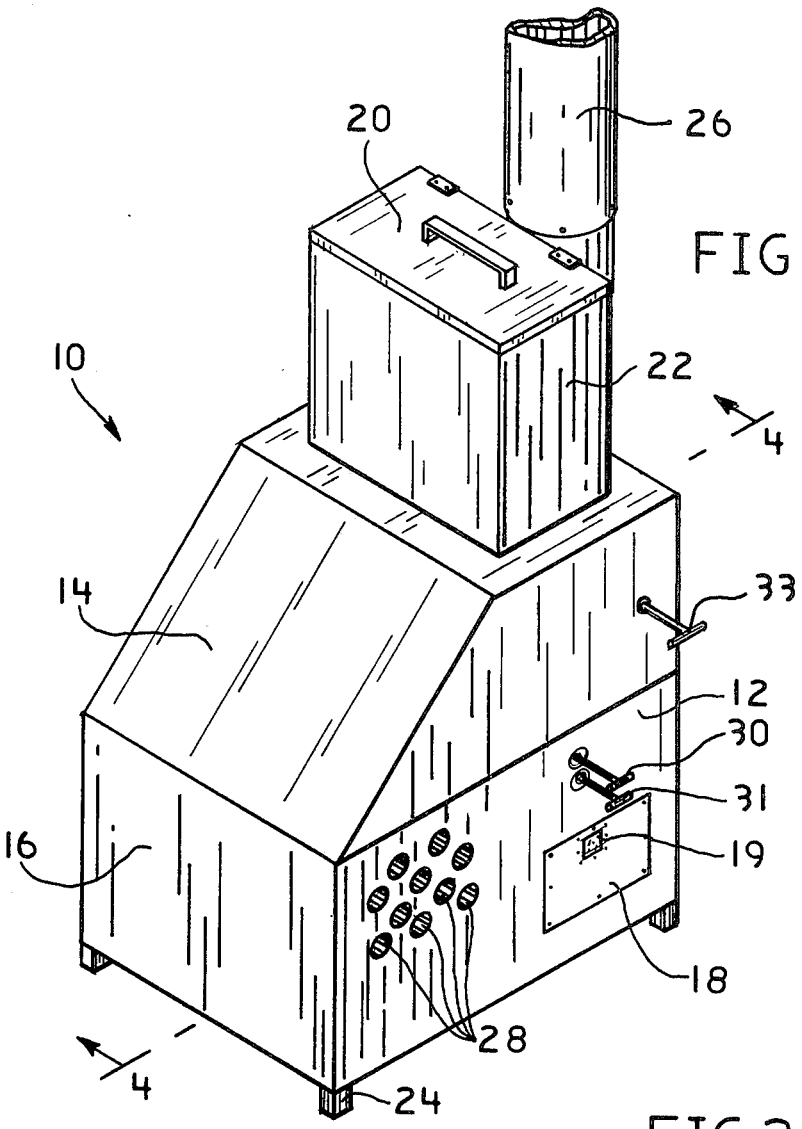
FIG. 1 is an isometric view of an embodiment furnace of the invention.
Figure 2:
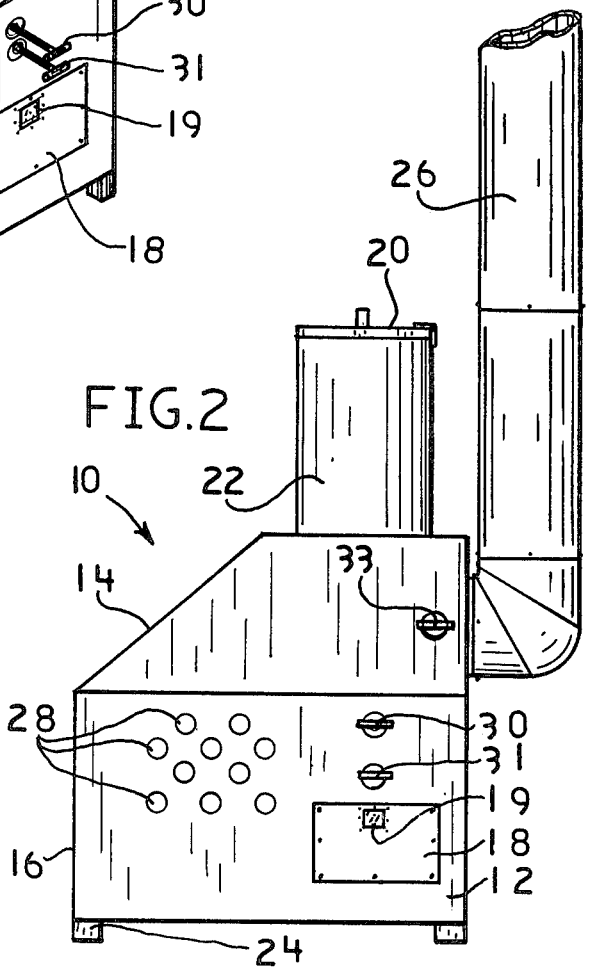
FIG. 2 is an end view of the furnace of FIG. 1.
Figure 3:
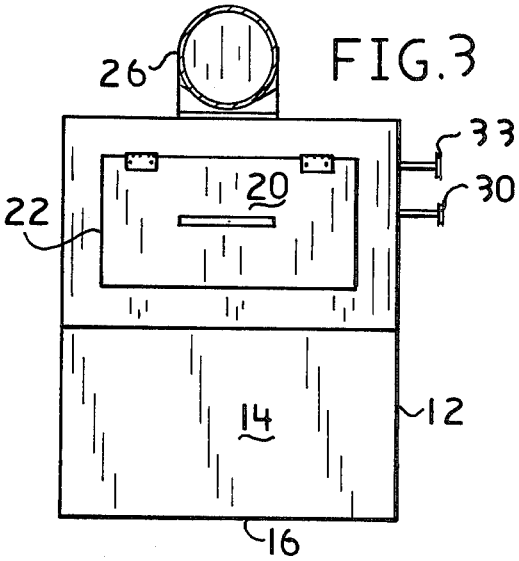
FIG. 3 is a top view of the furnace of FIG. 1.
Figure 4:
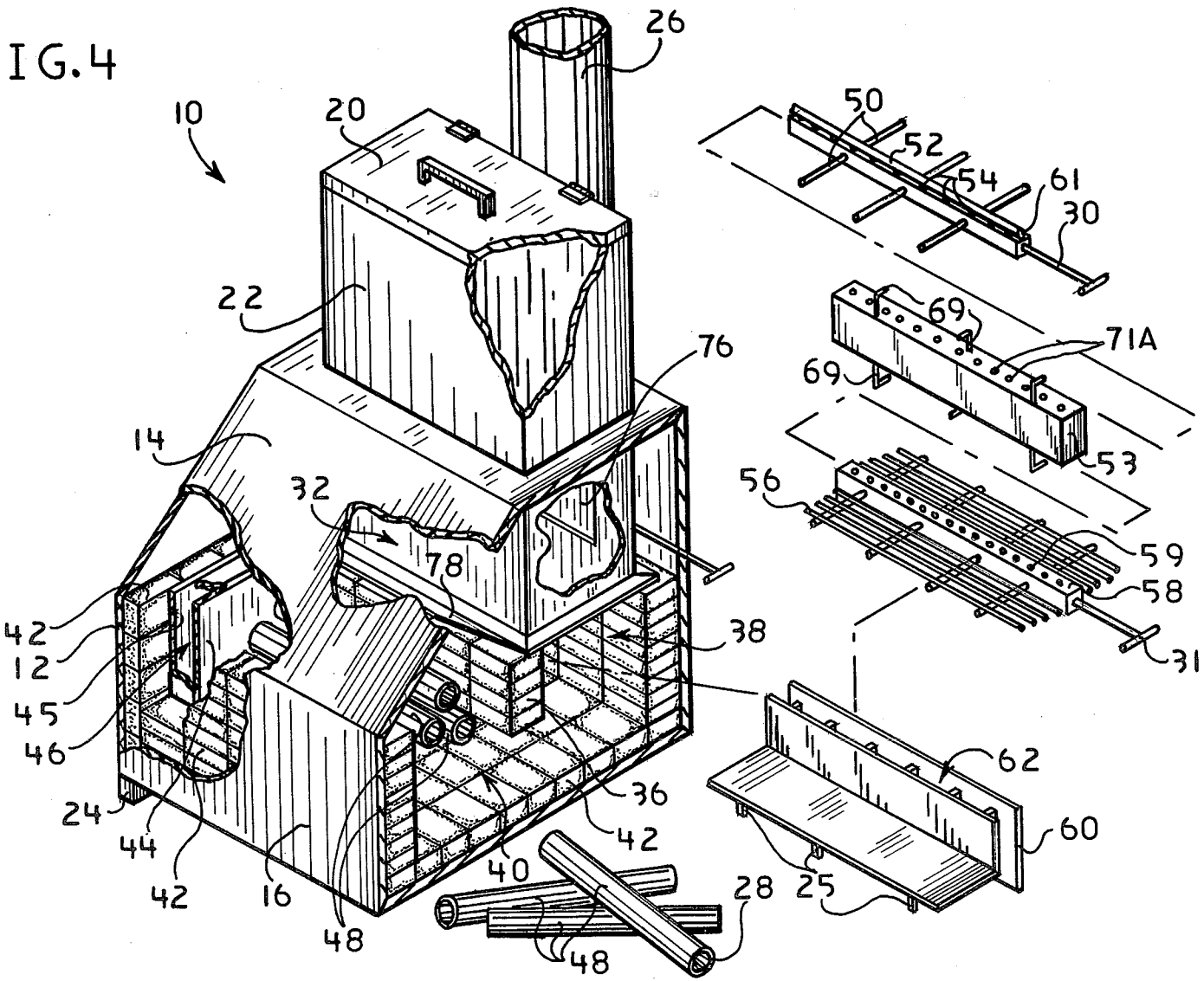
FIG. 4 is an exploded view along lines 4—4 of FIG. 1, partly sectioned and disassembled to show inner components.

FIG. 1 is an isometric view of a preferred embodiment furnace 10 of the invention. The furnace 10 comprises a heat-resistant enclosure 12 which preferably is fabricated from a heat conductive material such as sheet metal, cast iron and the like materials. The upper end 14 is a heat exchange radiator while the lower end 16 functions as a radiator and also encloses the combustion chambers. Access to the combustion chamber may be had through access door 18 and to the grates for loading solid fuels through hinged closure 20 on log chute 22. In a preferred embodiment, chute 22 may be flared outwardly towards the bottom. A thermal glass peephole 19 provides visual access to observe the combustion chamber. It is not necessary that the chute 22 extend above the heat exchange radiator area 14, however the extension increases fuel capacity for loading the furnace 10. The furnace 10 may be spaced off the supporting floor or like surface by legs 24. A flue pipe 26 is mounted on the rear of furnace 10. A plurality of combustion air inlets 28 pierce enclosure 12 to take in air for combustion in the combustion chambers. A single inlet 28 may be used if desired. Air distribution control rod handles 30, 31 also pierce the enclosure 12 and are slidably mounted therein. A control handle 33 also is slidably mounted through enclosure 12 and functions to open and close a bypass door 76 (not seen in FIG. 1). FIG. 2 is an end view of the furnace 10 and FIG. 3 is a top view, showing the relationship of the component parts viewable on the exterior. Interior furnace components may be seen by referring now to FIG. 4, a view along lines 4—4 of FIG. 1, partly sectioned with interior components in disassembly. The chute 22 defines an access means to load logs or other solid carbonaceous fuels into the combustion chamber. In extending to the combustion chamber the chute 22 traverses the heat exchanger 14 section which encloses a heat exchange chamber 32. Heat exchange chamber 32 is an open communication with the underlying combustion chamber which is divided by heat-resistant partition 36 into a first zone 38 and a second zone 40. Both of zones 38, 40 are preferably lined with a thermal insulator such as for example fire bricks 42. The partition 36 may also be constructed of the insulating fire brick 42. Any other means of insulating the combustion chamber may be used. It should be noted that wood in chute 22 also serves to insulate the combustion chamber. Total insulation of the combustion chamber helps maintain high temperatures therein, even at low rates of combustion. This assures combustion efficiency.

In the furnace 10, a double wall 44, 45 is spaced from the enclosure 12 at the side of the combustion chamber, forming an enclosed passageway which is completely isolated from any structure which would extract heat values from fluids traversing the passage 46; see for example fire bricks 42 isolating the walls 44, 45. A plurality of tubular conduits 48 traverse the chamber 40 and are mounted in wall 44 so as to form an enclosed pathway between inlets 28 and passageway 46. The tubular conduits 48 are fabricated of thermally conductive material such as steel and function as heat-exchangers to heat air passing from inlets 28. It is important to position conduits 48 near the outlet of the combustion chambers so that in extracting heat from the gaseous effluent of furnace 10, they do not cause the combustible vapors to cool below their ignition temperatures before being combusted. Preheating of intake air by combustion effluents only, takes place after combustion is complete, but before the effluents are allowed to transfer heat to outer surfaces of furnace 10. The passage 46 communicates also with the zone 38 through an outlet therein piercing the wall 44 adjacent zone 38 (not seen in FIG. 4). Mounted in the zone 38 beneath chute 22 is grate 50 adapted to support wood logs as fuel for combustion. Integrally formed with grate 50 is an air control member 52 bearing a plurality of exhaust nozzles 54 spaced in a row substantially evenly along its length and traversing the body of the member 52 from upper surface to lower surface. The member 52 is slidably mounted on the upper surface of manifold 53 which is connected to the outlet of conduit 46 and receives air therefrom for distribution of the nozzles 54 of the member 52 through apertures 71A which form a row in a the upper surface of manifold 53 and which may be placed in alignment with the similarly positioned nozzles 54 in the member 52. By sliding member 52 forward and back with the aid of attached rod handle 30, one can align or misalign the apertures 71A in manifold 53 with the nozzles 54 in the member 52, thereby controlling the flow of air ultimately exhausted to zones 38 through the nozzles 54. This permits a finite metering of air for combustion, evenly distributed to all points within the combustion chamber where initial and primary combustion is to take place. Beneath grate 50 is a second grate 56 adapted to hold burning coals dropped thereon from initially combusted logs on grate 50. Integrally associated with grate 56 in a second slidably mounted air control member 58 which is identical in structure and function to member 52. The member 58 may be slid on the lower surface of manifold 53 and has exhaust nozzles 59 spaced uniformly along its length and which distribute air to the zone beneath grate 56 and immediately above the entrance to passage 62. Air is carried to the nozzles 59 of member 58 by apertures 71B in the lower surface of manifold 53. These apertures (not seen in FIG. 4) are aligned and misaligned by manually pulling or pushing rod handle 31 in the same manner used to control air passing through nozzles 54. Pegs 69 secure slidably the air control members 52, 58 in position on manifold 53. Positioned immediately under member 58 is passage member 60 supported by legs 25 and which comprises a fire-resistant, double wall member forming a passage 62 which communicates between zones 38 and 40 by piercing the partition 36. The attachment of control rods 30, 31 to the grates 50, 56, respectively also provides a means to manually vibrate the grates on occasion to shake loose ash and other combustion residues.

FIG. 5 is a cross-sectional elevation of the front of the furnace 10 as shown in FIG. 2. In the preferred furnace 10 the passage 46 is divided into an upper passage 46A and a lower passage 46B by wall 66. It will be observed that by bisecting passage 46, half of the tubular conduits 48 feed air to the upper passage 46A segregated from air fed to the lower passage 46B by the other half of the plurality of tubular conduits 48. The arrows show the flow of air for combustion entering tubular conduits 48 through inlets 28, then into the closed conduits 46A, 46B. As shown in FIG. 6, a view along lines 6—6 of FIG. 5, the air flow continues from passage 46A across to the wall 44 of zone 38 where it passes through portal 70 in wall 44 and into the upper chamber 57A of manifold 53 (refer briefly to FIG. 9). From chamber 57A the air flows through apertures 71A to member 52 and ultimately through nozzles 54 for uniform, even distribution to the zone 38. By withdrawal of rod 30, partially, to misalign the apertures 71A with nozzles 54, the air flow is reduced. However, because each nozzle 54 is reduced in size to the same degree, the proportion of air distributed through each nozzle 54 remains the same relative to the remaining nozzles. Thus, the structure of the member 52 advantageously assures that regardless of the rate of air flow, there is always an equal distribution of air proportions to all parts of the initial combustion zone. This precludes uneven and incomplete combustion of fuel. The same occurs through member 58 for control of air distribution for secondary combustion. FIG. 7 is a view along lines 7—7 of FIG. 6 and shows that air from the lower passage 46B enters the combustion chamber through portal 72 piercing wall 44. Portal 72 is connected within zone 38 to the lower chamber 57B of manifold 53 (refer again briefly to FIG. 9) and the chamber 57B is in communication with the member 58 as previously described, whereby air may be preheated and delivered to the inlet of passage 62 through nozzles 59 in member 58. Control of the air proportions through nozzles 59 is carried out by alignment and misalignment of the nozzles 59 with the apertures 71B, in the same manner as described above for controlling the air proportion delivered through nozzles 54, i.e.; by sliding member 58 using control handle 31. An even and equal distribution of pre-heated air is thereby delivered to the passage 62, regardless of the air volume.

The operation of furnace 10 may be understood by referring now to FIG. 8, a cross-sectional elevation of another side of the furnace 10.

Logs or like solid carbonaceous fuel elements are placed on the grate 50 by loading through hinged closure 20 into chute 22. By filling chute 22, the logs are fed downwardly to grate 50 as the underlying logs are consumed in combustion zone 38. As the logs descend in chute 22 they pass through the heat-exchanger 14 section and are prewarmed so that upon entry into zone 38 they will not "cool" the fire therein by absorbing heat unnecessarily in being brought up to ignition temperature. Further, if the logs are wet, some drying will be achieved prior to ignition. To initially fire the furnace 10, closure 20 is secured to close chute 22 and bypass door 76 in the wall of chute 22, is opened by manipulation of rod 33 (note, the connection to door 76 is not shown in FIG. 8. The connection may be a conventional arrangement to open and close the door 76 by use of rod 33 so that initially the furnace 10 operates as a conventional updraft furnace, the products of combustion rising through the logs and passing through door 76 into flue stack 26. When the logs on the surface of grate 50 are burning sufficiently to support continued combustion (access door 18 may also be open to provide draft for initial firing; see FIG. 1) the doors 76, 18 are closed. Simultaneously rod 30 is adjusted so that air taken in at inlets 28 and passing through conduits 48 and 46A are dispensed by nozzles 54 at the upper surface or fuel ignition zone immediately adjacent grate 50 in a desired proportion. Thus, primary air is evenly distributed at the base of the logs in the fuel ignition zone. In the fuel ignition zone the combustible is brought to ignition temperature with the precise proportion of air required for initial combustion and to sweep volatiles to a secondary combustion zone. Observation of the flame may be made through peephole 19 and the rod 30 adjusted so a slow, steady, first stage combustion is obtained with the proper proportion of air. As the log is converted to coals, the coals fall through grate 50 to land on coal grate 56 beneath the initial fuel ignition zone. The primary air, as indicated by the arrows in FIG. 8, flows downwardly from nozzles 54, through the fuel ignition zone immediately above grate 50 and through the hot coals on grate 56. Passing through the hot coals, the exhausted primary air flow extracts volatile gases such as carbon monoxide, hydrocarbons and the like. The primary art at this point is low in oxygen content and for practical purposes exhausted as a combustion support, the oxygen having combined in the fuel ignition zone with the burning fuel to form carbon monoxide and water. The primary air flow together with the extracted volatiles then passes into the zone 40 through passageway 62. The gaseous fuel mixture passing into passage 62 is generally at ignition temperature, such being maintained by the completely insulated walls 42 of the combustion chamber in both zones 38 and 40. Ideally the actual combustion zone is small so that intense combustion and high temperature can be achieved in a limited, heavily insulated area. The volatile gases are maintained at or above ignition temperature and generally the only thing needed to ignite the gas mixture is additional oxygen in correct proportions. The passage 62 and nozzles 59 are positioned in proximity to the initial combustion zone, so that sparks, open flame, etc. are close enough to the secondary combustion mixture to assure instant ignition of the volatile gas mixture by initiating reaction. This is provided by the injection of secondary air from the second nozzles 59 positioned immediately above the inlet of passage 62. The secondary air is taken in by inlets 28 of those tubular conduits 48 associated with lower conduit 46B and ultimately dispensed to the mouth of passage 62 by the evenly spaced nozzles 59 on member 58. In this manner there is a complete, intimate and nearly instantaneous mixture of fresh air containing oxygen with the hot fuel-gas mixture leaving the coal grate 56. Since the fuel-gas mixture is at or above ignition temperature, there is immediate combustion within passage 62 which may extend into the zone 40. By manipulating with handle 31 the alignment of the apertures 71B in manifold 53 with the nozzles in member 58, one can advantageously meter a correct proportion of secondary air for complete but efficient combustion of the gas mixture entering passage 62. The correct proportion of secondary air may be adjusted by observing the absence of smoke from the flue stack 26, by observation of a blue-white flame and by the monitoring of the stack gases for a high carbon dioxide, low carbon monoxide content. The hot combusted gases in zone 40 pass upwardly through the transverse conduits 48, transferring heat through the conduits 48 to the primary and secondary air passing to the nozzles 54, 59 thereby pre-heating the primary and secondary air so its entry in the zones 38, 40 respectively, will not cool the fuels therein below their ignition temperatures. The objective is to always maintain combustible gases at high temperature. Therefore conduits 48 should always be placed in a position where they will not be in contact with the combustible gases, but only with totally combusted gases. The hot exhaust gases continue from the zone 40 into the heat-exchange 14 section as shown in FIG. 8. An optional baffle 78 extends transverse to the gas flow as shown by the arrows, to restrict and retain the gas for a short residence in the heat-exchange 14 section. The sloping of the front portion 14A and the restriction caused by the presence of chute 22 all add to turbulent mixing and the retention of gas in the radiator 14 section for a short residence to facilitate heat transfer from the hot exhaust gases to the heat conductive radiator 14 section. The radiator 14 section radiates heat to the surrounding environment and serves to warm the area. Heat is also conducted to the lower section 16 of the enclosure and radiated thereby. The exhaust gases then exit to flue stack 26 as shown by the arrows in FIG. 8. By selection of adequate radiator areas, including the area provided by chute 22, it has been my experience that the exhaust gases entering flue stack 26 have been extracted of their heat content for all practical purposes and are relatively cool, an indication of the efficiency of the furnace 10.

Figure 9:
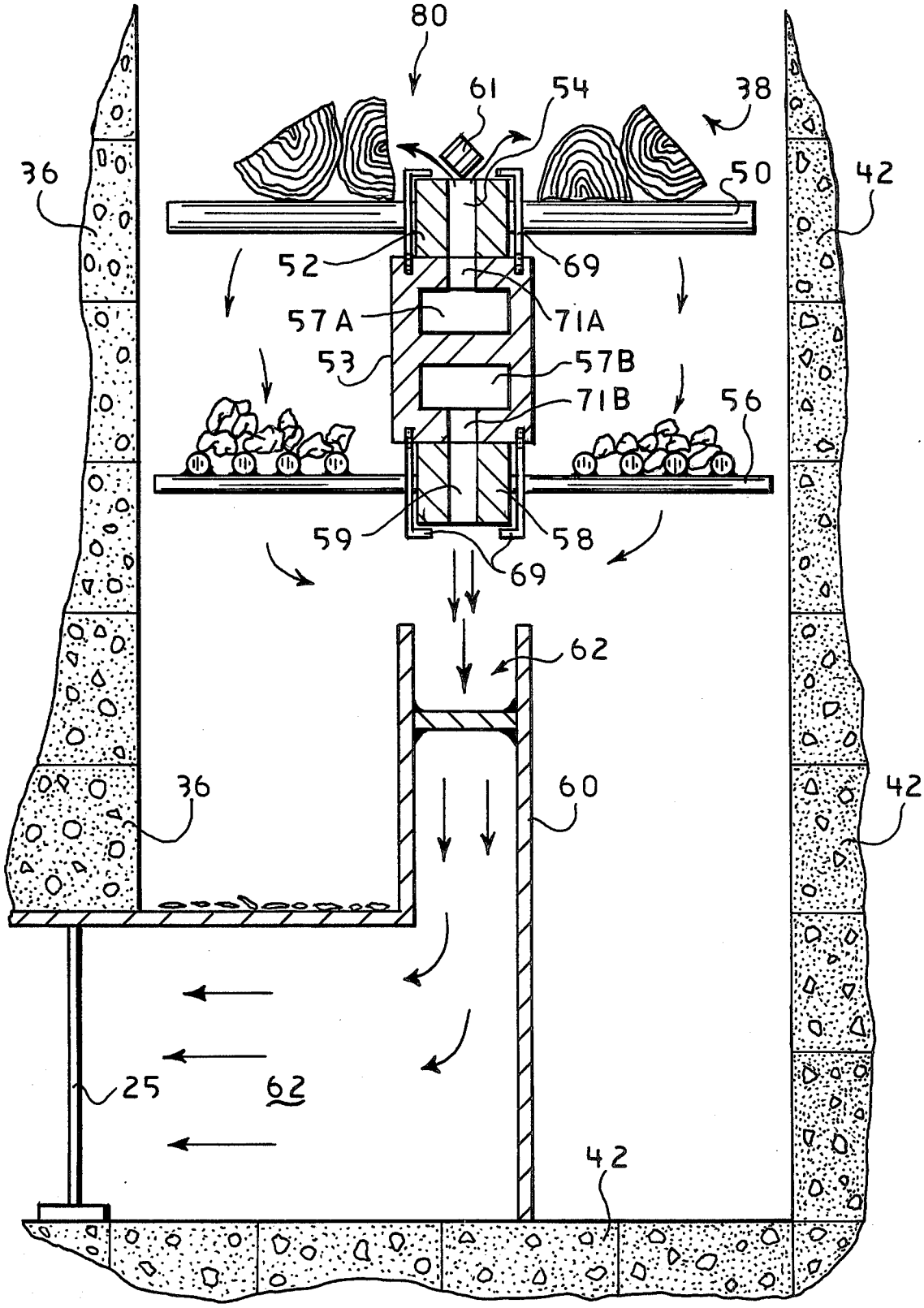
FIG. 9 is an enlarged view of the grate area of the furnace shown in FIG. 1.

FIG. 9 is an enlarged view of the grate area of the furnace 10 and shows further details of the means for combusting solid, carbonaceous fuels. The primary air, i.e.; air introduced through nozzles 54 of member 52 is delivered at the base of the fuel to be ignited in a fuel ignition zone 80 where the fuel is carbonized and water is driven off. Although some heat is derived by this initial combustion, it is only a small percentage of the heat value to be derived. The arrows show the primary air flow from nozzles 54 and in one embodiment a shield 61 can be inserted above the nozzles 54 to divert the air flow in the desired direction and to protect the nozzles 54 from filling with ash. The charcoal (hot coals) fall to coal grate 56 where the partially exhausted primary air is forced through the bed of coals with volatiles produced in zone 80. Here the coals (charcoal) are combusted, producing most of the heat and proportions of carbon monoxide and carbon dioxide as well as water vapor. Generally, the oxygen content of the primary air is depleted in combustion of the charcoal on grate 56. The hot gases may be maintained hot in the combustion chamber by insulation of the combustion chamber with, for example, the firebrick 42 and by introduction of pre-heated air for combustion. As the hot gases are carried into the passage 62 leading to the second zone, the fresh, oxygen rich secondary air injected into the hot gases from nozzles 59 (see arrows designating flow) provides support for further combustion and the secondary ignition may kick the combustion temperature up in an intense flash in a very limited zone. This permits the oxidation of the carbon monoxide to carbon dioxide with a consequent exotherm and heat release. As much as 60 percent additional heat value may be obtained by this final combustion. In summary, the furnace 10 of the invention provides three stages of combustion in a very small combustion zone at high temperatures, resulting in complete and efficient combustion. The three stages are (1) driving off moisture and breaking down of the fuel into charcoal, (2) combusting the charcoal to release gaseous volatile fuels and (3) combusting the volatiles. The residual ash falls to the floor of the combustion chamber under zone 38.

Figure 10:
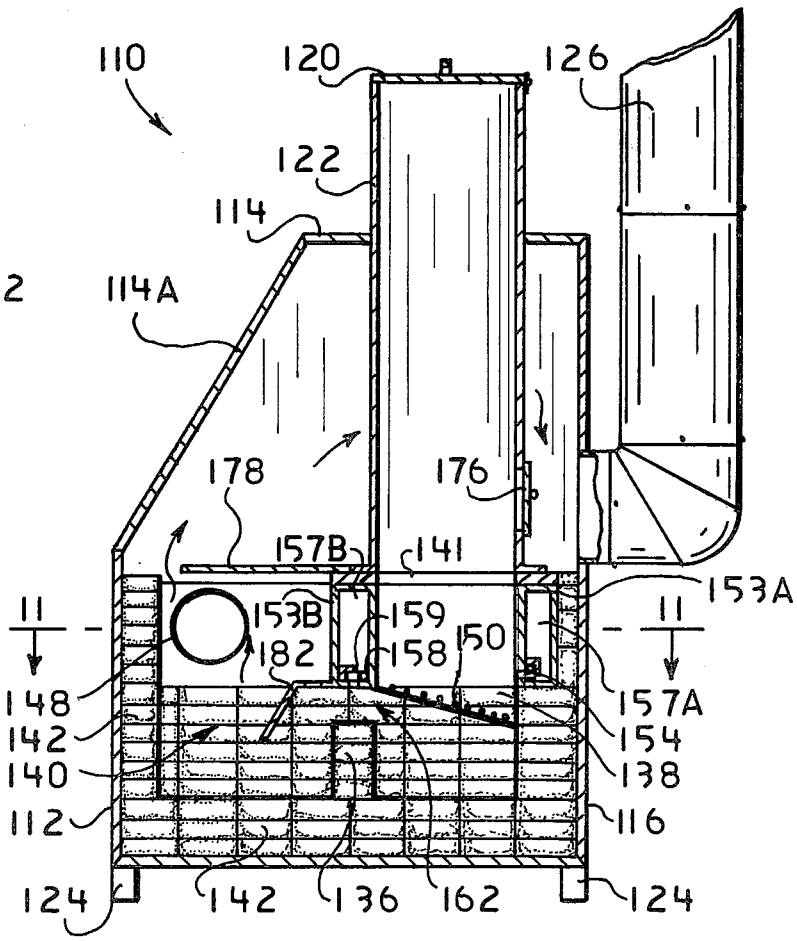
FIG. 10 is a cross-sectional end elevation of an alternate embodiment furnace of the invention.

FIG. 10 is a cross-sectional side elevation of an alternate embodiment furnace 110 of the invention. In the FIG. 10, components comparable to the parts of the furnace 10 are generally identified by the same numerals increased by a factor of 100. The furnace 110 shown in FIG. 10 differs signficantly from furnace 10 only in the grate and air manifold arrangement. As seen in FIG. 10, a single grate 150 supports solid fuel such as logs. The logs are delivered to grate 150 by removing closure 120 and inserting the log material in chute 122. The zone 138 is separated from zone 140 by a partition 136 which makes division of the chamber defined by enclosure 116 and firebrick lining 142. The enclosure 116 is supported by legs 124 and includes a radiator heat exchange section 114 which is above and in open communication with the zone 140. Primary air inserted into the zone 138 through manifold 153A defining chamber 157A travels through burning charcoal, completing combustion therein and carrying volatile gases into passage 162 and into the second zone 140. A baffle 182 at the outlet of passage 162 assumes complete mixture of volatile gases with secondary air and forces the volatile mixture to the hot bottom of zone 140. The baffle 182 improves combustion efficiency by (a) increasing the flame path, (b) increasing turbulent mixing of the gas mixture and (c) by funnelling all components of the gas mixture together; thus if one side of passage 162 is hot enough for secondary combustion but the other side is not, by bringing all gases together, they may all obtain a temperature sufficient for secondary combustion. The hot volatile gases carried into passage 162 are generally at ignition temperature or higher and are combusted after the introduction of secondary air into passage 162 from manifold 153B. Note that manifold 153B forms part of wall 136. It will also be seen that manifolds 153A and 153B are isolated from the chute 22 by insulator strip 141, to prevent cooling of the intake air. The combusting gases travel up past single tubular conduit 148, which is heated thereby, and on past an optional baffle 178. In the upper radiation section 114, the hot gases transmit their heat to the heat conducting surfaces of the radiator 114 and below to the 116 section, including the exposed portions of chute 122. The heat exhausted gases then flow through the tortured route to flue stack 126. A bypass door 176 is in the sidewall of chute 122 to permit start-up of the furnace without requiring downdraft induction of the initially combusted gases. The air flow in the downdraft furnace 110 is shown by the arrows in FIG. 10.

Figure 11:
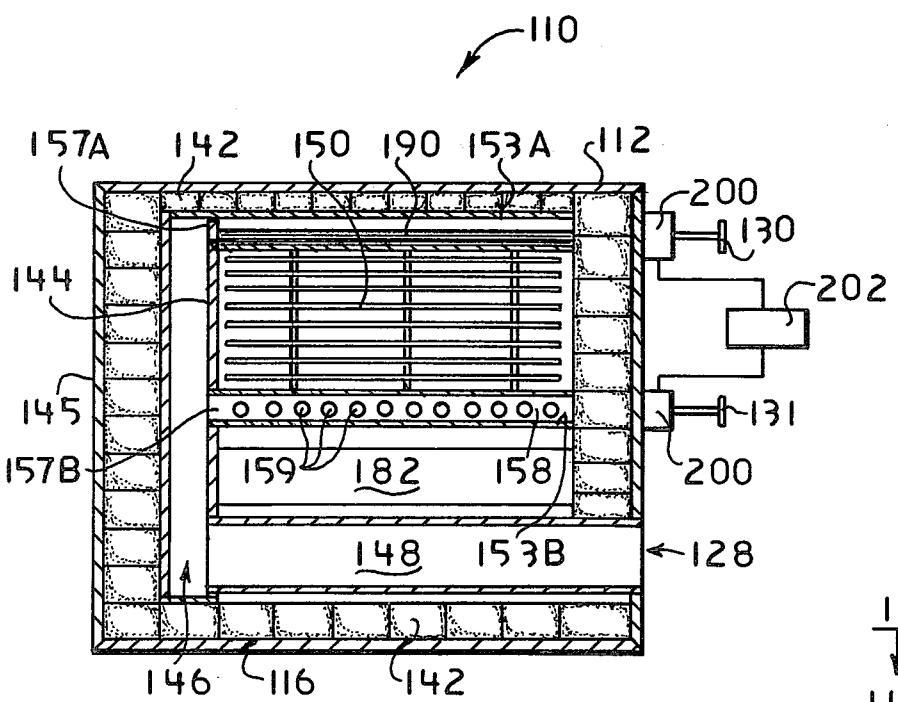
FIG. 11 is a view along lines 11—11 of FIG. 10.

FIG. 11 is a view along lines 11—11 of FIG. 10 and shows further details of the air flow of combustion air taken into inlets 128 of the furnace 110 and split for delivery between the manifolds 153A and 153B. In the embodiment furnace 110, the sources of pre-heated air for combustion are not segregated for separate delivery to the separate manifolds 153A, 153B but rather empty through a common passage 146 into the separate hollow manifolds. In FIG. 11, one may see delivery of the pre-heated air through the nozzles 159 of manifold 153B into the passage 162.

FIG. 10A is an enlarged cross-sectional side elevation of the manifold 153A as shown in FIG. 10. The manifold 153A defines a hollow air way 157A. An aperture 171A communicates between air way 157A and the outside. Interposed between the aperture 171A (which is one of a plurality distributed along the length of manifold 153A) is a slidable air control member 152 supported on bracket 190. The air control member 152 bears a plurality of nozzles 154 therein, corresponding in location and dimension to the apertures 171A. By sliding member 152 and aligning or misaligning the apertures 171B with the nozzles 154, the rate of air flow discharged by nozzles 154 may be controlled without changing the equality of air distribution through each nozzle 154. The manifold 153B has a structure analogous to 153A and provides the same distribution of air to the passage 162 by sliding an air-control member 158 which is located in air way 157B and is identical in structure and function to air-control member 152 in air way 157A.

FIG. 11 also shows control rods 130 and 131 mounted on slidable members 152 and 158 respectively to facilitate control of air delivery. The slidable members 152 and 158 being slidably mounted include nozzles 154 and 159 to operate in essentially the same manner that members 52 and 58 operated to control air for furnace 10. In a preferred embodiment of furnace 10 or furnace 110, the air control rod handles 30, 31 or 130, 131 are movable by solenoids 200 which may be mounted so as to move the rods independently, simultaneously. Solenoids 200 may be actuated by a thermostat control 202. Preferably, the thermostat is of the On-Off type, i.e.; has two set points for actuating solenoids 200. The first set point (On position) opens the nozzles 154 and 159 sufficiently to allow combustion in the combustion zones at an accelerated rate. Ideally this opening would be for an optimum flow of air to the combustion zones permitting maximum efficiency and complete combustion. The second set point may be responsive to ambient temperature in the area surrounding the furnaces 110 and 10 and comprises an Off position. When this set point is reached, the thermostat 202 signals solenoids 200 to close the nozzle openings 154 and 159 sufficiently to slow down the combustion rate of the fuel within the combustion zones. Generally, this is not a complete closure of the nozzles 154 and 159 but merely sufficient closure to decelerate the rate of combustion to a minimum necessary for maintaining a pilot flame. When the ambient temperature falls below the second set point on thermostat 200, the solenoids 200 are again signaled to open the nozzles 154 and 159 for accelerated combustion again.

Those skilled in the art will appreciate that many modifications may be made to the above-described preferred embodiments of the invention without departing from the spirit and the scope of the invention. For example, although the embodiments have been described in relation to the burning of wood logs, it will be appreciated that my modification of the grate 150, a coal grate may be used to fire the furnaces 10 and 110 with coal. Water conduits could also be passed through heater sections of the furnaces 10 and 110 to provide for heat exchange to circulating water.

The furnaces of the invention advantageously reduce the amount of volatile materials reaching the stacks 26 or 126, thereby reducing the hazard of a chimney fire.

What is claimed is:

1. A downdraft, solid carbonaceous fuel fired furnace, which comprises;

a heat-resistant enclosure defining an interior chamber;

a heat-resistant partition dividing the chamber into a first zone and a second zone;

a passageway through said partition with an inlet in the first zone and an outlet in the second zone;

a thermally conductive, closed pipe traversing the second zone, having an inlet opening outside of the enclosure and an outlet opening into the chamber;

a grate mounted in the first zone dividing the first zone into a fuel ignition zone and an ash receiving zone;

means for access to the grate for loading solid, carbonaceous fuels therein;

a manifold mounted on an outlet of said pipe and traversing the first zone, said manifold adapted to exhaust a gas at a first point adjacent the upper surface of the gate and at a second point adjacent to said passageway inlet; and means of controlling air flow volume delivered by said manifold;

wherein said means of controlling comprises an air control member slidably mounted on said manifold and having a plurality of nozzles corresponding to and adapted to mate with the adaptation on said manifold so as to adjust the size of the manifold outlets by alignment and misalignment of the manifold outlets with said nozzles.

2. The furnace of claim 1 wherein said means for access comprises a portal in said enclosure and a movable closure for the portal.

3. The furnace of claim 1 wherein said first and second zones are at least partially lined with a thermally insulative material.

4. The furnace of claim 1 said outlet of the closed pipe enters into the first zone.

5. The furnace of claim 1 which additionally comprises a second grate mounted below the first grate and adapted to hold charcoal coals falling from the first grate.

6. The furnace of claim 1 wherein said manifold is adapted by the presence of a plurality of nozzles along upper and lower surfaces.

7. The furnace of claim 1 which further comprises a heat-conducting radiator section mounted above the second zone so as to receive heated fluids rising from the second zone.

8. The furnace of claim 1 wherein the manifold comprises a first manifold pipe adjacent the upper surface of the grate and a second manifold pipe adjacent said passageway inlet.

9. The furnace of claim 1 wherein the means for access to the grate comprises a chute passing through the enclosure and originating outside of the enclosure and terminating in the area of said grate.

10. The furnace of claim 1 including a thermostatically actuated means for adjusting the air flow through said manifold.

11. The furnace of claim 1 wherein said manifold is further adapted to exhaust a gas substantially evenly along its length.

12. A downdraft, solid carbonaceous fuel fired furnace, which comprises;

a heat-resistant enclosure defining an interior chamber;

a heat-resistant partition dividing the chamber into a first zone and a second zone;

a passageway through said partition with an inlet in the first zone and an outlet in the second zone;

a thermally conductive, closed pipe traversing the second zone, having an inlet opening outside of the enclosure and an outlet opening into the chamber;

a grate mounted in the first zone dividing the first zone into a fuel ignition zone and an ash receiving zone;

means for access to the grate for loading solid, carbonaceous fuels therein;

a manifold mounted on an outlet of said pipe and traversing the first zone, said manifold adapted to exhaust a gas at a first point adjacent the upper surface of the grate and at a second point adjacent to said passageway inlet;

said manifold being a conduit defining an inner chamber, said inner chamber being divided into upper and lower chambers, said upper chamber providing the exhaust gas at the point adjacent to the upper surface of the grate and the lower chamber providing the exhaust gas to the point adjacent the passageway inlet.

13. A downdraft, solid carbonaceous fuel fired furnace, which comprises;

a heat-resistant enclosure defining an interior chamber;

a heat-resistant partition dividing the chamber into a first zone and a second zone;

thermal insulation lining the walls of the first and second zones;

a passageway through said partition with an inlet in the first zone and an outlet in the second zone;

a first set of a plurality of heat-exchanger tubes traversing the second zone, having inlets opening outside of the enclosure and outlets opening into a first conduit having an outlet into the first zone;

a second set of a plurality of heat-exchanger tubes traversing the second zone, having inlets opening outside of the enclosure and outlets opening into a second conduit having an outlet into the first zone;

a first grate mounted in the first zone and adapted to support log fuels;

a second grate mounted below said first grate and adapted to support coals;

a fuel loading chute passing through the enclosure above said grates and having a first end outside said enclosure and a second open end terminating above said first grate;

a manifold pipe having a plurality of apertures distributed substantially evenly along its length on upper end lower surfaces mounted on the outlets of the first and second conduits and traversing the first zone at a point between the first grate and second grates;

a first air control member having a plurality of apertures distributed substantially evenly along its length and traversing its body to communicate between upper and lower surfaces, said apertures corresponding in size and location to the apertures on the upper surface of the manifold pipe, said air control member being slidably mounted on the upper surface of said manifold pipe so that the apertures of the upper surface of the pipe may be aligned and misaligned with the apertures of the air control member by sliding said air control member on the upper surface of the manifold pipe;

a second air control member having a plurality of apertures distributed substantially evenly along its length and traversing its body to communicate between upper and lower surfaces, said apertures corresponding in size and location to the apertures on the lower surface of the manifold pipe, said second air control member being slidably mounted on the lower surface of said manifold pipe so that the apertures of the lower surface of the pipe may be aligned and misaligned with the apertures of the lower surface of the second air control member by sliding said second air control member on the lower surface of the manifold pipe; and a heat radiator section above the second zone and in open communication therewith at one end and in communication with a flue stack at its other end, said section including baffle means to form a maze for gases exhausted from the second zone to the flue stack, said chute forming part of the baffle means.

* * * * *